United States Patent [19]

Chalberg et al.

[11] Patent Number: 4,823,413

[45] Date of Patent: Apr. 25, 1989

[54] COMBINED PNEUMATIC SWITCH AND AIR CONTROL FOR USE IN WHIRPOOL BATHS

[75] Inventors: Philip E. Chalberg, Costa Mesa; Manochehr Gordbegli, Santa Ana; Paul N. Kenchel, Costa Mesa, all of Calif.

[73] Assignee: Hydrabaths, Inc., Santa Ana, Calif.

[21] Appl. No.: 168,112

[22] Filed: Mar. 14, 1988

[51] Int. Cl.[4] ..... A61H 33/02

[52] U.S. Cl. ..... 4/544; 239/61

[58] Field of Search ..... 4/492, 541, 542, 543, 4/544; 128/66; 239/428.5, 61

[56] References Cited

U.S. PATENT DOCUMENTS

| | | | |
|---|---|---|---|
| 2,587,335 | 2/1952 | Landergott . | |
| 3,159,849 | 12/1964 | Jacuzzi . | |
| 3,271,790 | 9/1966 | Schneider et al. . | |
| 3,319,266 | 5/1967 | Schneider et al. . | |
| 3,580,247 | 5/1971 | Schneider . | |
| 3,742,521 | 7/1973 | Bolgert et al. . | |
| 3,986,217 | 10/1976 | Doerr et al. | 4/542 |
| 4,233,694 | 11/1980 | Janosko et al. . | |
| 4,577,353 | 3/1986 | Viegener | 4/544 |
| 4,592,100 | 6/1986 | Robertson et al. | 4/542 X |
| 4,602,391 | 7/1986 | Shepherd . | |
| 4,637,080 | 1/1987 | Hutchinson | 4/541 X |

FOREIGN PATENT DOCUMENTS

| | | |
|---|---|---|
| 0078127 | 5/1983 | European Pat. Off. . |
| 0132797 | 2/1985 | European Pat. Off. . |
| 1224308 | 3/1971 | United Kingdom . |
| 1460206 | 12/1976 | United Kingdom . |
| 1496613 | 12/1977 | United Kingdom . |
| 2026317 | 2/1980 | United Kingdom . |
| 1604587 | 12/1981 | United Kingdom . |
| 2107180 | 4/1983 | United Kingdom . |
| 2114021 | 8/1983 | United Kingdom . |
| 2120546 | 12/1983 | United Kingdom . |
| 2159404 | 12/1985 | United Kingdom . |
| 2161072 | 1/1986 | United Kingdom . |
| 2163952 | 3/1986 | United Kingdom . |
| 2169799 | 7/1986 | United Kingdom . |

*Primary Examiner*—Chris K. Moore

*Attorney, Agent, or Firm*—Leonard Tachner

[57] ABSTRACT

A unitary apparatus combines the pneumatic switch and air control functions of separate conventional devices thereby eliminating the requirement to put two separate devices in a jetted whirlpool bath or spa. Two embodiments of the invention are disclosed herein. In each such embodiment, in addition to the pneumatic pump there is an air control body joined to a threaded body, the latter housing an air outlet and a push tube positioned concentrically within a rotatable face member. The push tube provides a button the depression of which activates the air pump using a pneumatic pulse. The face provides a means for controlling the whirlpool action generated at the output of a plurality of Venturi jets attached to the system. The face is substantially resistant to removal which would expose an easily removable plunger tube, tapered ring and other small members of the invention. This latter feature makes it necessary to fully depress the push tube before it becomes possible to disassemble the face from the remainder of the apparatus. In one embodiment the air pump is configured to permit its replacement from the interior of the tub without requiring access to the tub exterior.

4 Claims, 6 Drawing Sheets

COMBINED PNEUMATIC SWITCH AND AIR CONTROL FOR USE IN WHIRLPOOL BATHS

BACKGROUND OF THE INVENTION

1. Field of the Invention

The present invention relates generally to devices for use in whirlpool baths and more specifically, to an apparatus which combines the functions of pneumatic switch and air volume control in one integrated unit and which also provides certain additional safety and operational features.

2. Prior Art

The use of a pneumatic switch to activate and deactivate whirlpool baths is well-known in the art. The principal advantage of a pneumatic switch in whirlpool baths is that it obviates the requirement for having any form of electrical apparatus accessible to the user for turning on and turning off the whirlpool bath. This makes it possible to provide the switch either within or adjacent the tub or spa thereby making it convenient for the user to either activate or deactivate the pump of the whirlpool bath while remaining in the tub or spa. The user may have such control access and yet still preclude the possibility of accidental electrocution which might otherwise arise in the event an electrical switch were at or adjacent the whirlpool bath.

It is also well-known in the art to provide an air control either within or adjacent the whirlpool bath so that the user has the capability of varying the volume of air mixed with water in the Venturi jets of the whirlpool bath installations a plurality of whirlpool bath Venturi jets are attached to a common water line and a common air line. The water line is normally connected to a pump to permit a high rate of water flow through the Venturi jets. The air line may be connected to a pump but is more often connected to a single air inlet port to ambient air pressure. As is well-known in the whirlpool bath art, the velocity imparted to the water which is ejected from the Venturi jets creates a suction effect on the air line through Venturi action thereby causing air to mix with the water to create a stream of mixed air and water and propel air bubbles into the whirlpool bath. By controlling the air volume in the air line it is possible to vary the whirlpool action of the whirlpool bath. Thus an air control commonly provides the user with a means for varying the aperture diameter of the air inlet port thereby controlling the volume of air in the air line.

Numerous examples of both prior art pneumatic switches and prior art air controllers will be discussed hereinafter in conjunction with FIGS. 1–9.

The following U.S. patents and foreign patents disclose examples of prior art relevant to varying degrees to the present invention:

| Country | U.S. Pat. No. | Inventor(s) |
|---|---|---|
| U.S.A. | 2,587,335 | Landergott |
| U.S.A. | 3,159,849 | Jacuzzi |
| U.S.A. | 3,271,790 | Schneider et al |
| U.S.A. | 3,319,266 | Schneider et al |
| U.S.A. | 3,580,247 | Schneider |
| U.S.A. | 3,742,521 | Bolgert et al |
| U.S.A. | 3,986,217 | Doerr et al |
| U.S.A. | 4,233,694 | Janosko et al |
| U.S.A. | 4,602,391 | Shepherd |

| Country | Patent No. | Applicant(s) |
|---|---|---|
| Britain | 1,224,308 | Jacuzzi Research, Inc. |
| Britain | 1,460,206 | Jacuzzi Research, Inc. |
| Britain | 1,496,613 | Ruth Kulisch |
| Britain | 1,604,587 | Michael Axton May |
| Britain | 2,026,317 | Robert Jean Dupont |
| Britain | 2,107,180 | Spa Baths Limited |
| Britain | 2,114,021 | Clive Richard Randle |
| Britain | 2,120,546 | Alan Fitzgeorge Carr et al |
| Britain | 2,159,404 | John Theophilus Brueton |
| Britain | 2,161,072 | John Theophilus Brueton |
| Britain | 2,163,952 | Nigel Charles Savage |
| Britain | 2,169,799 | Heatons Bathrooms Limited |
| European | 0 078 127 | Cleo D. Mathis |
| European | 0 132 797 | Heddernheimer Metallwarenfabrik |
| W. Germany | G 83 07 972 | Franz Viegener II |

U.S. Pat. No. 3,271,790 to Schneider et al is directed to a therapeutic bath fluid circulating system and provides for the pump/motor being located outside of the tub with a low voltage switch located within the tub to minimize the danger to the user by a short in the electrical system.

U.S. Pat. No. 3,319,266 to Schneider et al is directed to a therapeutic bath fluid circulating device and provides for a handle member whereby operation of the handle allows a rod to be raised or lowered to open or close a valve. Thus, this is directed to a system which provides for a control by a user within the bathtub.

U.S. Pat. No. 3,986,217 to Doerr et al is directed to a whirlpool bath device that includes manual water/air controls which are accessible to the user while in the whirlpool bath. They provide an air control cap for controlling the flow of air entering through an input. There is an adjustable output nozzle assembly which may be manipulated to control the direction of the discharge of water entrained with air.

U.S. Pat. No. 4,233,694 to Janosko et al is directed to a spa construction and isolate controls. The electrically isolated controls are carried by the shell and are accessible to the user from within/without the shell for controlling the pumps and the heater elements. This includes control knobs which are mounted on a front panel to provide access to the users within the spa. However, these appear to be electric switch members and are not pneumatic switches as provided in the present invention.

West Germany Patent No. G 83 07 972 discloses a combined air regulator and pneumatic switch but does not provide the structural and convenience features of the present invention nor does it provide the highly advantageous safety feature of the present invention.

SUMMARY OF THE INVENTION

Unlike much of the prior art known to the applicants, in the present invention the functions of pneumatic activation and air control are provided in a unitary apparatus which combines both of these functions. This eliminates the need for installing two devices in a jetted whirlpool bath or spa. Such a combination permits easier installation, greater convenience to the user and easier control of inventory by the supplier. In addition to combining the normal pneumatic switch with the normal air control, the air control function of the present invention permits full air adjustability by simply manually turning of the face of the device. In addition it permits easy activation and deactivation of the water pump by simply depressing a button plunger also at the face of the device. Of particular additional significance, the present invention provides a safety feature which is especially effective in regard to small children. More specifically, in the present invention a unique tongue and safety groove configuration prevents removing the face of the device from the whirlpool bath tub wall without first depressing the pneumatic switch plunger.

Two embodiments of the invention are disclosed herein, each such embodiment differing from the other only in the type of pneumatic pump used to generate a pulse of air pressure to pneumatically control activation and deactivation of the system. In each such embodiment, in addition to the pneumatic pump there is an air control body joined to a threaded body, the latter housing an air outlet and a push tube positioned concentrically within a rotatable face member. The push tube provides a button the depression of which activates the air pump using a pneumatic pulse. The face provides a means for controlling the volume of air in the air line of the system thereby permitting the user to control the whirlpool action generated at the output of a plurality of Venturi jets attached to the system.

Aside from the highly advantageous combining of a pneumatic switch and an air control in the same apparatus, the present invention also provides additional advantageous features. By way of example, the air outlet of the invention is provided with a structure having a check valve for allowing air to exit the air control body but preventing water from entering. This feature thus prevents a backflow of water from Venturi jets or other portions of the whirlpool bath system from entering the air control body of the present invention and exiting into the area behind the tub wall causing flooding. The check valve structure is provided with a novel stem which extends downwardly into the air control body adjacent a tapered ring. The tapered ring is used to control the air volume in the system and thereby control the action of the whirlpool bath. This novel stem provides a definitive end point of the excursion range of the tapered ring thereby giving the user a definitive start and stop point for controlling the air volume within the whirlpool system. Most importantly, the present invention provides a critical and highly advantageous safety feature. Specifically, the face of the present invention which is normally used to control the air volume in the whirlpool assembly to which the invention is connected, is effectively resistant to tampering which might otherwise result in its removal which would expose an easily removable plunger tube, tapered ring and other small members of the invention. This feature is especially advantageous in view of the unpredictable behavior of small children. This latter feature employs safety tongues on the push tube portion of the invention which cooperate with safety grooves on the face member of the invention, making it necessary to fully depress the push tube before it becomes possible to disassemble the face from the tube remainder of the apparatus of the invention. Thus, the present invention, in addition to providing a novel combination of function in a singular unit, provides certain additional features which make the unit more convenient and safe to the user.

OBJECTS OF THE INVENTION

It is therefore a principal object of the present invention to provide a combined pneumatic switch and air controller for a whirlpool bath or spa thereby obviating the prior art requirement for providing separate individual units for performing two distinct functions.

It is an additional object of the present invention to provide a combined pneumatic switch and air controller for whirlpool bath applications and comprising a push tube button for actuating the pneumatic switch and a rotatable face for effecting air control.

It is still an additional object of the present invention to provide a combined pneumatic switch and air controller for a whirlpool bath system and having a safety feature which effectively prevents the disassembly of the face of the apparatus accessible from the inside the tub without full depression of the push tube normally used to control the air volume.

It is still an additional object of the present invention to provide a combined pneumatic switch and air controller for a whirlpool bath system wherein system activation may be effected by the user within the whirlpool bath tub by depressing a button to activate the system or deactivate the system and air control may be effected by rotating the face of the unit for controlling air volume and wherein the air volume control rotation is within defined mechanical limits so that the user can sense calibration of air volume within those limits.

It is still an additional object of the present invention to provide a combined pneumatic switch and air controller for a whirlpool bath system which in one embodiment utilizes an air pump which may be removed and replaced from inside the tub so that the pneumatic switch portion of the present invention may be repaired without requiring access to the exterior portion of the tub in which the present invention is installed.

BRIEF DESCRIPTION OF THE DRAWINGS

The aforementioned objects and advantages of the present invention, as well as additional objects and advantages thereof, will be more fully understood hereinafter as a result of a detail description of preferred embodiments when taken in conjunction with the following drawings in which.

DETAILED DESCRIPTION OF PREFERRED EMBODIMENTS

Figure 2:
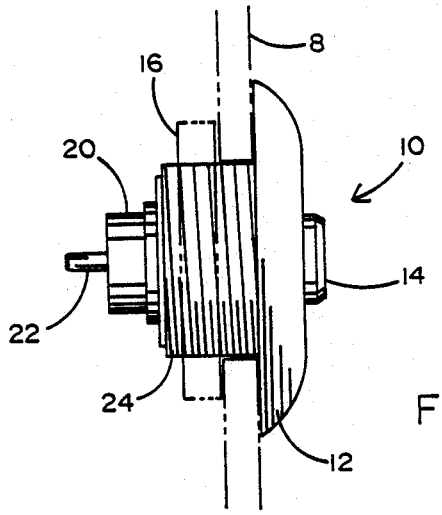
FIG. 2 PRIOR ART
FIGS. 1 through 9 depict various views of prior art pneumatic switches and prior art air controllers for whirlpool bath system and which may be advantageously replaced by the present invention.
Figure 1:
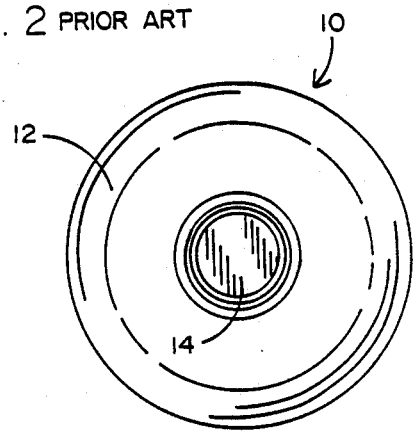
FIG. 1 PRIOR ART
Figure 3:
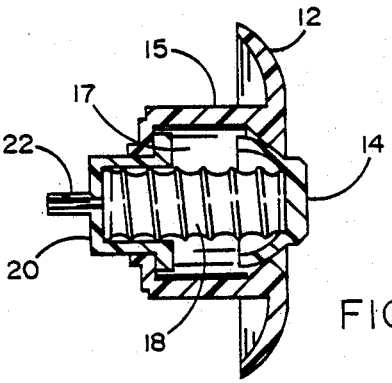
FIG. 3 PRIOR ART

Reference will first be made to FIGS. 1–9 which provide various illustrative examples of prior art devices, some of which are pneumatic switches and some of which are air controllers for whirlpool baths. A first such prior art pneumatic switch 10 is shown in FIGS. 1–3 and comprises a face 12 which is situated on the inside of a tub wall 8, being secured thereto by a nut 16 on a threaded portion 24 of a body 15. A button 14 is provided, which, as seen best in FIG. 3, is in communication with a bellow 18, the latter extending rearward from face 12 to a pump body 20 within chamber 17 of body 15. The bellows terminates in a tube 22 which extends from the rear surface of the pump body 20. Tube 22 is adapted to be connected to a pneumatic switch line which comprises a flexible tube (not shown) which is in turn connected at its other end to a pneumatic inlet on a diaphragm control pump (not shown). By using the pneumatic switch 10 of the prior art, one can activate the water pump or deactivate the water pump by simply depressing the button 14 which, in turn, compresses the bellows 18 sending a pulse of high pressure air through tube 22 toward the pump. The pump is configured to be turned on or off in response to a corresponding movement of a diaphragm. Pneumatically activated water pumps are well-known in the art and need not be shown or discussed herein in any detail.

Figure 4:
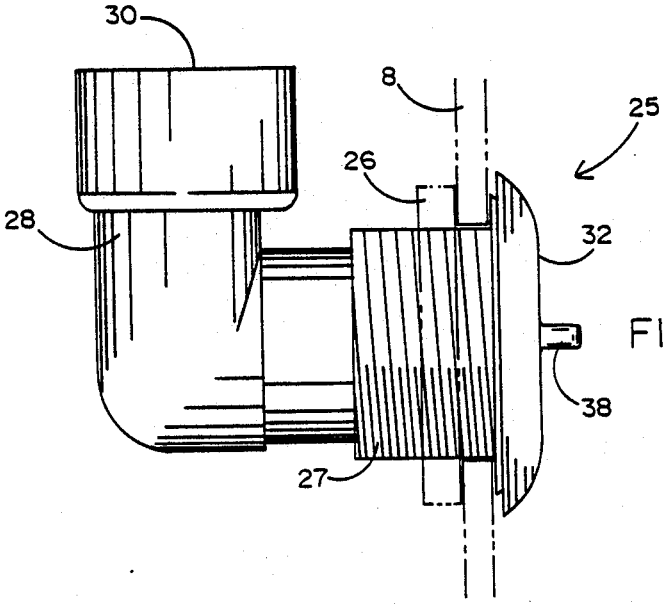
FIG. 4 PRIOR ART
Figure 5:
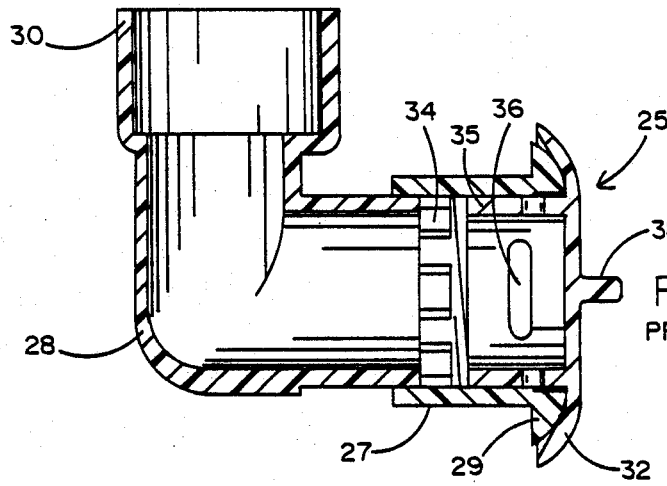
FIG. 5 PRIOR ART

A prior art air control 25 is illustrated in FIGS. 4 and 5. Air control 25 is also designed to be secured to a tub wall 8 by means of a threaded nut 26 which may be selectively tightened against the wall 8 by being threaded on threaded body 27. Threaded body 27 is, in turn, affixed to an elbow 28 having an air connector 30. The only portion of the prior art air control 25 which is available inside the tub wall 8 is a face 32 which includes a finger grip 38 to permit convenient rotation of the face. Face 32 is an integral portion of an air control body 35 which provides a pair of air holes 36 seen best in FIG. 5. Threaded body 27 may be glued to elbow 28 and a plurality of stops 34 radially dispersed about the inner surface of threaded body 27 prevents the elbow from interfering with the operation of the air control body 35. In the configuration shown in FIGS. 4 and 5, prior art air control 25 is shown in its closed configuration, that is, with its face 32 fully threaded into threaded body 27 until the face 32 is in engagement with flange 29 of the threaded body 27. In this configuration, the air holes 36 are fully blocked from the ambient air by the closing threaded body 27. As a result, little or no air can flow through connector 30, which is normally connected to an air line and Venturi jets which mix the air and water to create the whirlpool effect. On the other hand, when face 32 is unthreaded from body 27, air control body 35 is rotated within the threaded body 27 until the face assumes the position shown in phantom line in FIG. 5 thereby exposing the air holes 36 to external air. As a result, air is allowed to pass through the holes 36 and into the elbow 28, the connector 30 and the air line surrounding the whirlpool bath tub and into the Venturi jets connected thereto. One disadvantage of the air control configuration of the prior art air controller 25 is that the air is sucked in through the space between the face 32 and the tub wall 8 due to the suction effect created by the Venturi action of the jets installed around the tub wall. As a result, the air flow within the tub causes a suction sound which can be annoying and may also subject the tub user to a suctioning effect against the body. The user may, in fact, inadvertently block the air flow with his body thereby interfering with the whirlpool action.

Figure 6:
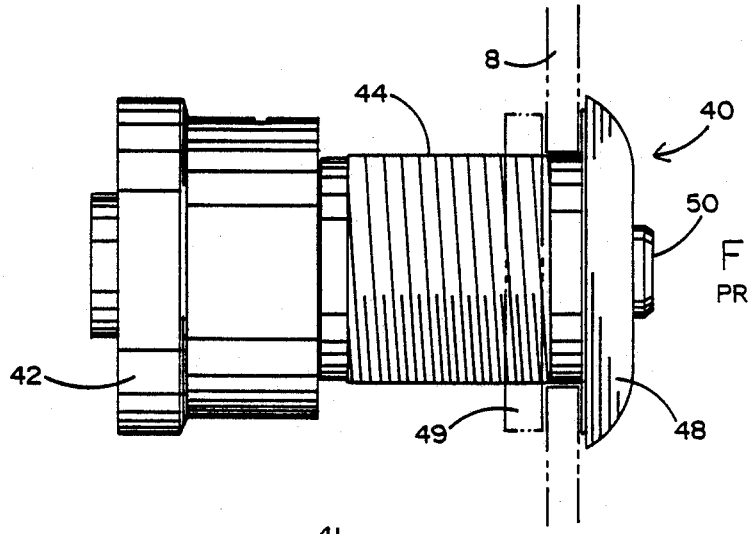
FIG. 6 PRIOR ART
Figure 7:
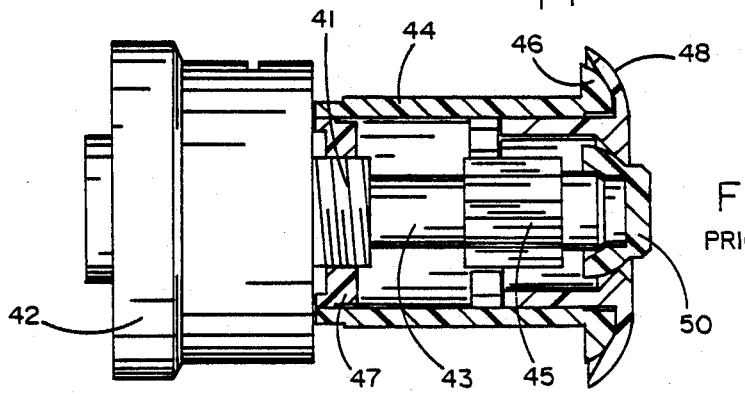
FIG. 7 PRIOR ART

A second prior art pneumatic switch 40 is shown in FIGS. 6 and 7. This device is also secured to the tub wall 8 by means of a nut 49 which is threaded to a body 44 thereby leaving a face 48 extending inside the tub. This prior art pneumatic switch 40 utilizes a pump 42 from which there extends a threaded member 41 and a plunger 43. The threaded member 41 is secured to a threaded rear member 47 which encloses the body 44. Plunger 43 engages a push tube 45 which extends axially along the body 44 through a centrally positioned aperture in face 48. A button 50 is provided and extends beyond the outer surface of face 48 to provide the user with a convenient means for depressing push tube 45 which in turn depresses plunger 43. Depression on plunger 43 produces a pulse of air emanating from the left-most portion of the pump 42 as seen in FIGS. 6 and 7. The concept of the prior art pneumatic switch 40 of FIGS. 6 and 7 is essentially identical to that of FIGS. 1, 2 and 3 except that the amount of air volume is greater due to the substantially larger size of the external air pump 42 as compared to the internally contained bellows 18 of pneumatic switch 10 of FIGS. 1, 2 and 3.

Figure 8:
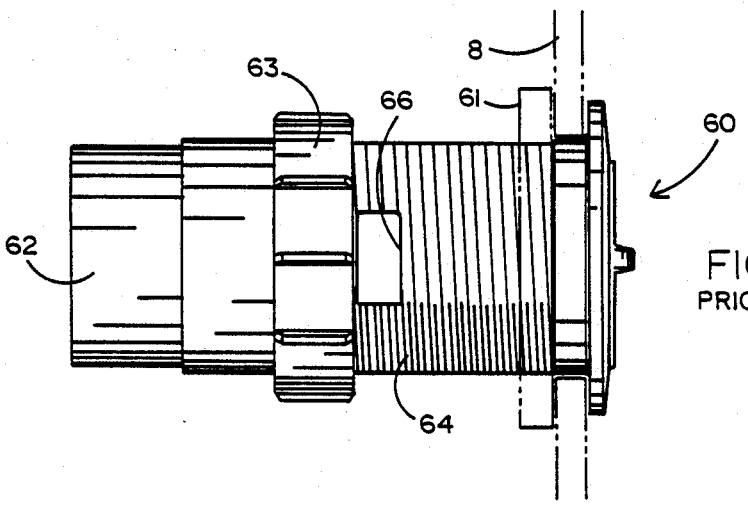
FIG. 8 PRIOR ART
Figure 9:
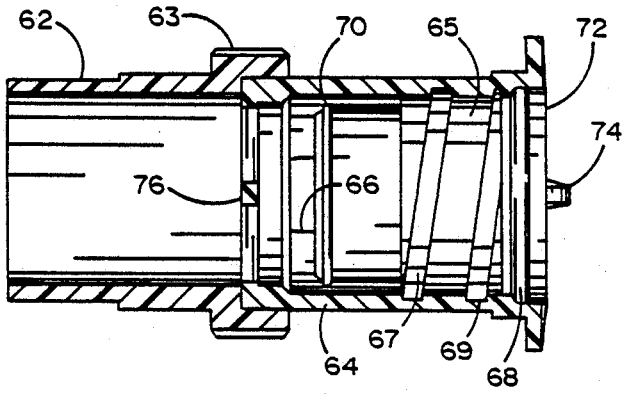
FIG. 9 PRIOR ART
Figure 13:
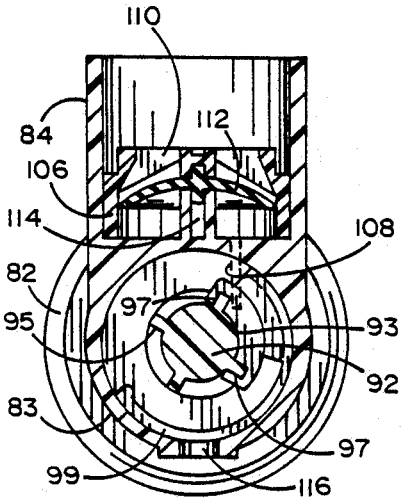
FIGS. 13 and 14 are similar cross-sectional views of the invention taken from the face side thereof and illustrating the air control function of the present invention.
Figure 14:
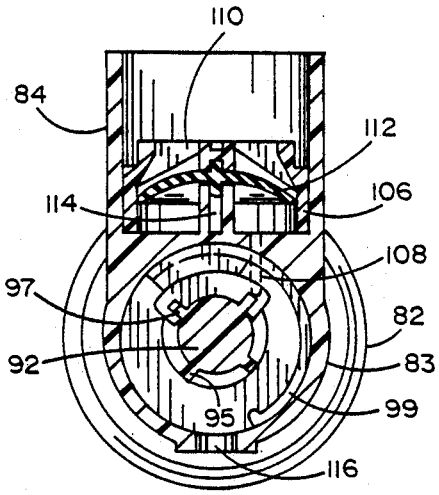
Figure 10:
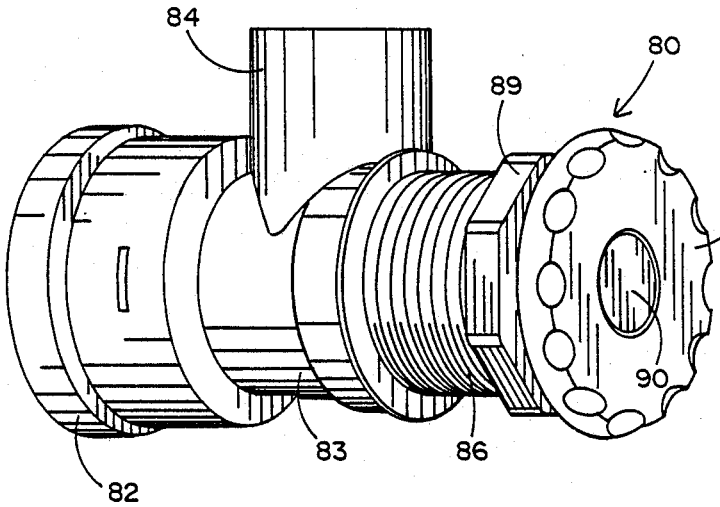
FIG. 10 is an isometric view of a first embodiment of the present invention.

An additional prior art air control 60 is shown in FIGS. 8 and 9. Air control 60 is similar in function to air control 25 of FIGS. 4 and 5. More specifically, prior art air control 60 is also secured to a tub wall 8 by means of a threaded nut 61 which is in turn secured to a threaded control body 64, the latter providing a pair of air holes 66. Control body 64 is threadably secured to an air channel 62, the latter being provided with a grip 63 to facilitate interconnection of the air channel 62 and the control body 64. As seen best in FIG. 9, within the control body 64 there is positioned a control cylinder 65 which is provided with a large helical thread 67 and a pair of O-rings 68 and 70. The interior surface of control body 64 is provided with a matching thread 69 to receive the helical thread 67 of control cylinder 65. Control cylinder 65 is connected to a control member 72 which is provided with a grip 74. When the grip 74 is turned fully in one direction, the control cylinder 65 is fully threaded into the control body 64 thereby positioning O-ring 70 behind the air holes 66. O-ring 70 thus blocks the air holes and prevents air from reaching the air channel 62. On the other hand, when grip 74 is turned in the opposite direction, control cylinder 65 is threadably pulled towards control member 72 thereby advancing O-ring 70 in front of air holes 66. This configuration permits air to enter through the air holes and into the air channel 62. A check valve 76 is provided at the rear end of control body 64 where it mates with the air channel 62 to prevent water from backflowing into the air control 60 but still allowing air to exit into air channel 62 to which the air line of the whirlpool bath system may be attached.

Reference will now be made to FIGS. 10–15 which illustrate the detailed structure of the first embodiment of the invention. More specifically, turning first to FIG. 10 it will be seen that the first embodiment 80 of the present invention comprises an air pump 82, an air control body 83 having an air outlet 84 extending therefrom, a threaded body 86, a rotatable face 88 and a button 90. As seen best in FIGS. 11 and 12, the combined pneumatic switch and air controller 80 of the present invention is secured to a tub wall 8 by means of a threaded nut 89 is much the same manner as the prior art. Nut 89 is adapted to engage the exterior threads of threaded body 86. Threaded body 86 includes an inner threaded portion which is adapted to receive a threaded extension 81 of face 88. Threaded body 86 also provides a flange 87 which is adapted to receive the inside surface of the face 88. The threaded portion of threaded body 86 is adapted to be threaded into a mating thread 101 in air control body 83. The rear end of air control body 83 is provided with a threaded aperture for receiving pump 82 and specifically the threaded portion thereof from which a plunger 85 extends. Air pump 82 may be identical to air pump 42 of the prior art device illustrated in FIGS. 6 and 7.

Plunger 85 of air pump 82, when depressed, provides a pulse of air which may be used to activate or deactivate a water pump by means of a pneumatic switch in much the same manner as disclosed above. A push tube 92 is provided for this purpose and includes a push tube insert 94 which is adapted to mate with plunger 85 for generating air pulses from pump 82. Push tube 92 is guided in its axial motion for compressing the plunger 85 of pump 82 by a push tube retainer 93 which is, in turn, supported integrally by an air control member 98. Push tube retainer 93 provides a pair of guide slots 97 spaced 90 degrees apart and adapted to receive push tube guides 95 which extend radially along push tube 93 at 90 degree intervals.

Air control member 98 comprises a tapered ring 99 which has substantially the same radius of curvature as the interior surface of air control body 83 and rests against that interior surface when installed therein. The passage of air through air control body 83 is designed to be in a substantially upward flow direction. For this purpose air control body 83 is provided with an air hole 116 at the bottom portion thereof as seen best in FIG. 12. Depending upon the position of tapered ring 99, the air may then flow through the air outlet 84 and into the air line surrounding the whirlpool bath to which a plurality of Venturi jets are connected.

Figure 12:
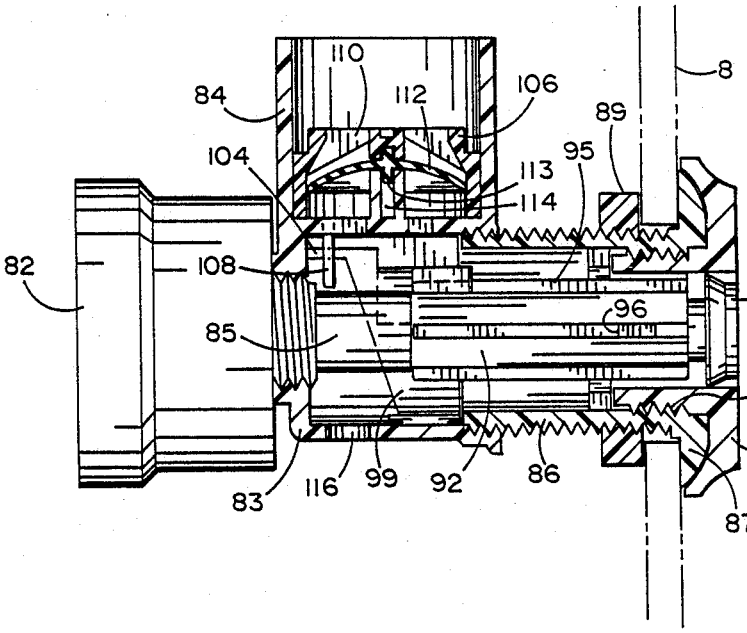
FIG. 12 is a partially cross-section view of the first embodiment of the invention.

The combined pneumatic switch and air controller 80 of the present invention also provides a valve retainer 106 which includes valve guides 110 housing a check valve 112 within a valve retention member 113 seen best in FIG. 12. The interface between the air control body 83 and air outlet 84 is provided with an air channel 114 adjacent check valve 112. The dimensions of tapered ring 99 are designed so that depending upon the circular position of air control member 98, all or a portion of air channel 114 may be blocked or air channel 114 may be entirely open to freely pass air into air control 84 and into the air line of the whirlpool bath system to which the invention is connected.

Air control member 98 is also provided with a stop 100 which has a first edge 102 and a second edge 104. These edges 102 and 104 are designed to engage a stem 108 which extends downward from the valve retainer 106 in a manner best seen in FIGS. 13 and 14. Thus the interaction of stop 100 and particularly its edges 102 and 104 with the stem 108 provides discernible limits for the tapered ring 99. This gives the user a sense of start and end points in turning the tapered ring by rotating face 88 to control the volume of air that passes through air control body 83 and thus control the whirlpool action of the system to which the invention is connected.

Figure 11:
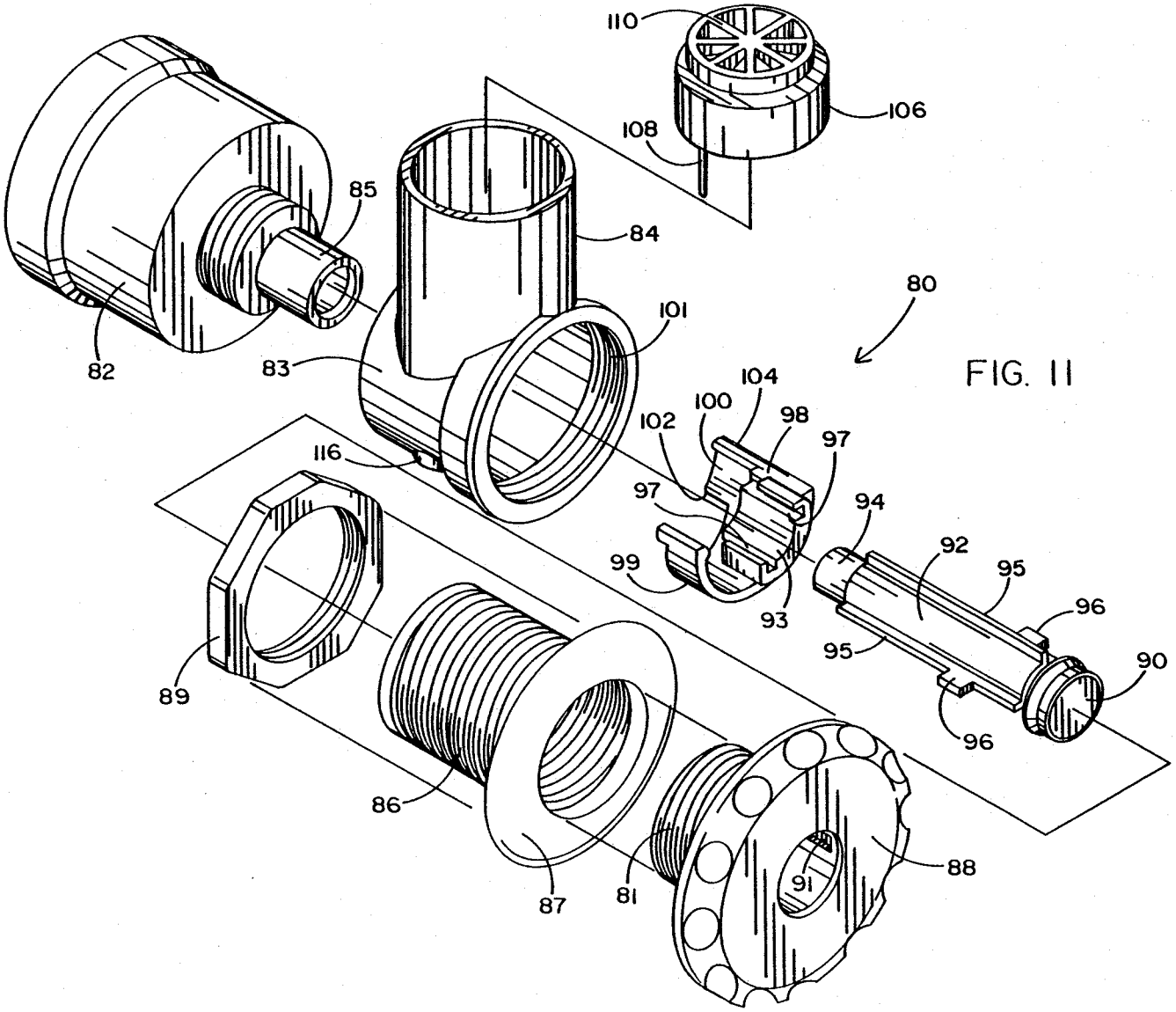
FIG. 11 is an exploded view of the embodiment of the invention illustrated in FIG. 10.
Figure 15:
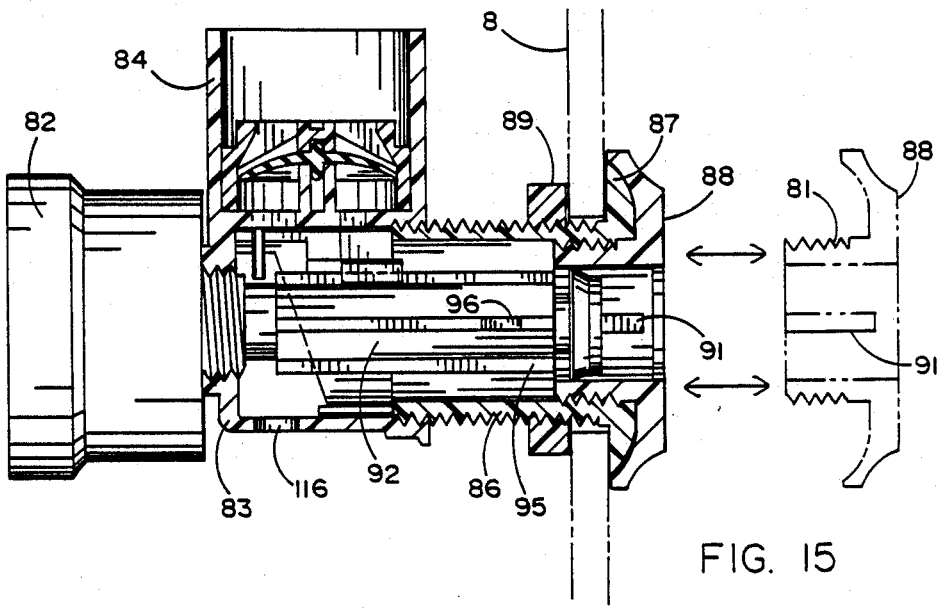
FIG. 15 is a partially cross-sectioned view of the first embodiment of the present invention similar to that of FIG. 12 but illustrating the use of the safety feature thereof.

As seen best in FIG. 11, push tube 92 is provided with a pair of safety tongues 96 which extend radially from the edges of push tube guides 95. During normal operation of the system of the present invention, safety tongues 96 are received by a pair of safety grooves 91 which are located in the interior of threaded portion 81 of face 88. When the push tube 92 is in its nominal operating position with button 90 substantially flush with the face 88, safety tongues 96 are positioned in safety grooves 91 thereby making it necessary for push tube 92 to rotate with the face 88. Consequently, the interaction of stop 100 of air control member 98 with the stem 108 of valve retainer 106 not only gives the user limits for the air control, but also acts to limit the extent to which the face 88 can be rotated. As a result, mere rotation of face 88 without any further action will not remove the face member 88 from the tub wall. This feature effectively renders the present invention child resistant.

However, removal of face 88 is still possible simply by depressing the push tube 92 while rotating the face member 88. Face member 88 may be removed by pushing push tube 92 inwardly toward the pump 82 until the safety tongues are beyond the confines of safety grooves 91. This is the configuration illustrated in FIG. 15. One may then remove the face member 88 by simply continuing the rotation thereof until the threaded portion 81 is disconnected from the threaded body 86. Replacement of the face member 88 is accomplished in the same manner simply by rotating the face member in the opposite direction, that is, clockwise while depressing the push tube 92 to the same extent illustrated in FIG. 15.

Thus, it will be seen that the unique structure of the present invention not only combines the two functions of pneumatic switching and air control in the same device, but also provides the important advantage of a tampering resistant safety feature requiring coordination of the motion of the push tube and face member simultaneously in order to remove the latter.

Figure 16:
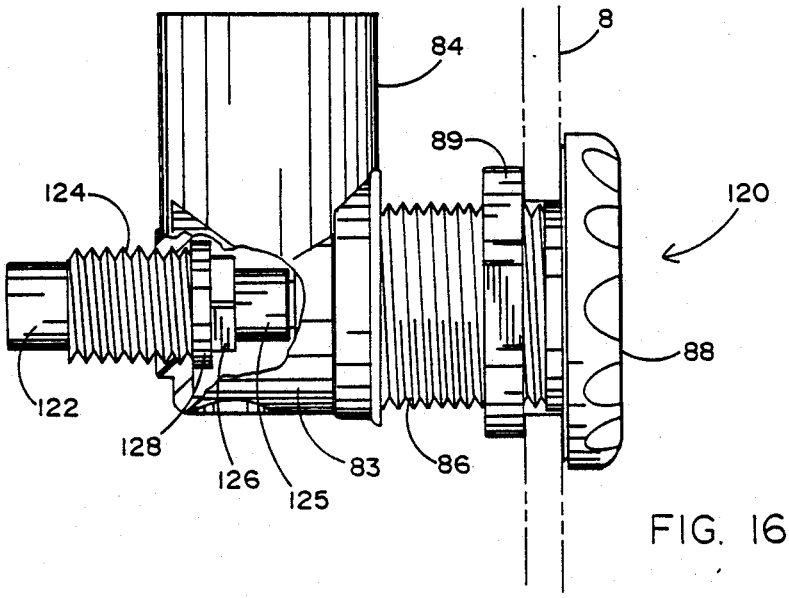
FIG. 16 is a partially cut-away view of a second embodiment of the present invention.

A second embodiment of the invention is illustrated in FIG. 16. This combined pneumatic switch and air controller 120 is identical to the first embodiment 80 in all respects except for the use of a pump 122. Pump 122, although of smaller configuration and therefore of lower air volume, is provided with a threaded portion which is designed to mate with the rear threaded portion of air outlet 84. It is also provided with a ring 128 and a fixed nut 126 from which a plunger 125 extends inwardly toward the face member 88. The distinction between the pump 122 of the second embodiment illustrated in FIG. 16 and the pump 82 of the first embodiment illustrated in FIGs. 10-15, is the manner in which it may be installed in the air outlet 84 of the invention. More specifically, unlike pump 82 of the first embodiment which can only be removed by unscrewing it from the rear wall of air control 84 and removing it away from the tub 8, pump 122 can be removed by pulling it toward the tub wall 8. Thus, it is possible in embodiment 120 to replace a defective pump 122 from inside the tub wall surface thereby rendering it unnecessary to gain access to the exterior of the tub. More specifically, after the face member 88 is removed in the manner described in conjunction with FIG. 15, the push tube 92 and the air control member 98 may also be removed. At this point one gains easy access to nut 126 which permits unscrewing the threaded portion 124 of pump 122 from the rear wall of air outlet 84 and removing same by pulling it toward the tub wall. Similarly, a new pump 122 may be installed by extending the threaded portion through the rear aperture of air outlet 84 and using the nut 126 to turn the thread until the ring 128 is in contact with the rear surface of air outlet 84. At this point the air control member 98, push tube 92 and face 88 may be reinstalled by simply reversing the steps previously described.

It will now be understood that what has been described herein comprises a novel and unique whirlpool bath accessory which combines two functions into one device. More specifically, the present invention is a combined pneumatic switch and air controller by which the user of a whirlpool bath can control activation and deactivation of the water pump and also control air volume which determines the whirlpool action of the system. One highly advantageous feature of the invention is a safety feature which renders the invention substantially child resistant, that is, resistant to tampering by children under a responsible age. More specifically, the present invention makes it impossible to remove the face portion thereof without simultaneously depressing a push tube to remove safety tongues from a pair of safety grooves that otherwise prevent the removal of the face member by merely rotating it alone. Two different embodiments of the invention have been disclosed; each substantially identical to the other except for the form of air pump that is used in the pneumatic switch portion of the invention. In one such embodiment the pump is large for generating a greater volume of air in response to depression of a push tube. However, in this embodiment it is necessary to gain access to the tub exterior in order to replace the air pump. In a second embodiment the air pump is configured to permit its replacement from the interior of the tub without requiring access to the tub exterior. However, this particular second embodiment pump is of a lower volume than the first and therefore may not be suitable for use with all pneumatic switch pump devices.

Those having skill in the art to which the present invention pertains, will now, as a result of the applicants' teaching herein, perceive various additions and modifications which may be made to the invention. By way of example, specific dimensions and shapes may be readily altered without changing the scope of the invention which is to be limited only by the claims appended hereto.

We claim:

1. A combined pneumatic switch and air control apparatus for a whirlpool bath, the whirlpool bath of the type having a plurality of Venturi-type jets dispersed about a tub wall and connected to an air line and a water line, the water line being connected to a pneumatically switchable water pump; the apparatus comprising:

a pneumatic pump having a depressible plunger for generating a pulse of air pressure for activating and deactivating said water pump;

a push tube affixed to said plunger and extending axially therefrom to provide access for depressing said plunger from within said tub wall, said push tube having at least one radially extending protrusion;

an air control body having an aperture for receiving said plunger, an air hole for admitting ambient air, an air outlet for connection to said air line and a threaded aperture for receiving a threaded body;

an integral push tube retainer and tapered ring, said tapered ring being shaped to rest against the inner surface of said air control body for selectively blocking air flow into the said air outlet, said push tube retainer having means for receiving said push tube in axial slideable engagement therewith along the axis of said threaded aperture;

a threaded body having a first threaded portion for connection to said air control body at said threaded aperture and a flange, said first threaded portion being adapted to extend through an orifice in said tub wall and said flange being adapted to engage the inside tub wall surface adjacent said orifice; and a face member having a second threaded portion for engaging said first threaded portion of said threaded body and a face portion for engaging said flange of said threaded body, said face member having an axially located channel for receiving said push tube said second threaded portion having at least one groove for receiving said push tube protrusion whereby rotation of said face portion rotates said tapered ring for regulating the air flow through said air control body;

said push tube protrusion being adapted to disengage from said face member groove upon depression of said plunger whereby to permit removal of said face member from said threaded body.

2. The apparatus recited in claim 1 further comprising a check valve positioned within said air outlet for preventing any backflow of water from entering said air control body.

3. A combined pneumatic switch and air control apparatus for a whirlpool bath, the whirlpool bath of the type having a plurality of Venturi-type jets dispersed about a tub wall and connected to an air line and a water line, the water line being connected to a pneumatically switchable water pump; the apparatus comprising:

a pneumatic pump having a depressible plunger for generating a pulse of air pressure for activating and deactivating said water pump;

a push tube affixed to said plunger and extending axially therefrom to provide access for depressing said plunger from within said tube wall, said push tube having at least one radially extending protrusion;

an air control body having an aperture for receiving said plunger, an air hole for admitting ambient air, an air outlet for connection to said air line and a threaded aperture for receiving a threaded body;

an integral push tube retainer and tapered ring, said tapered ring being shaped to rest against the inner surface of said air control body for selectively blocking air flow into the said air outlet, said push tube retainer having means for receiving said push tube in axial slideable engagement therewith along the axis of said threaded aperture;

a threaded body having a first threaded portion for connection to said air control body at said threaded aperture and a flange, said first threaded portion being adapted to extend through an orifice in said tub wall and said flange being adapted to engage the inside tub wall surface adjacent said orifice;

a face member having a second threaded portion for engaging said first threaded portion of said threaded body and a face portion for engaging said flange of said threaded body, said face member having an axially located channel for receiving said push tube, said second threaded portion having at least one groove for receiving said push tube protrusion whereby rotation of said face portion rotates said tapered ring for regulating the air flow through said air control body;

said push tube protrusion being adapted to disengage from said face member groove upon depression of said plunger whereby to permit removal of said face member from said threaded body;

a check valve positioned within said air outlet for preventing any backflow of water from entering said air control body; and a retainer for retaining said check valve, said retainer having a stem extending into said air control body, said tapered ring having a stop for engaging said stem when said air flow is fully blocked and when said air flow is fully unblocked.

4. An improved whirlpool bath apparatus of the type having a plurality of Venturi-type jets dispersed about a tub wall and connected to an air line and a water line; the apparatus comprising:

means for generating a pulse of air pressure for activating and deactivating a pneumatically switchable water pump connected to said water line;

means for selectively regulating air flow into said air line; and means preventing disassembly of said apparatus from inside said tub wall without simultaneous operation of said generating means and said regulating means.

* * * * *